US005333656A

United States Patent [19]

Mackal

[11] Patent Number: 5,333,656

[45] Date of Patent: Aug. 2, 1994

[54] AUTO INFLATOR HAVING DISSOLVABLE ELEMENT UNDER LOW PRESSURE

[76] Inventor: Glenn H. Mackal, 2586 25th Ave. North, St. Petersburg, Fla. 33713

[21] Appl. No.: 67,656

[22] Filed: May 26, 1993

[51] Int. Cl.[5] ..... B65B 1/04; B65B 3/04

[52] U.S. Cl. ..... 141/330; 141/19; 222/5; 441/93

[58] Field of Search ..... 141/328, 329, 330, 38, 141/17, 19; 222/5, 54, 83, 83.5; 441/93, 94, 95; 137/557, 559; 128/202.14, 203.21, 205.21

[56] References Cited

U.S. PATENT DOCUMENTS

| | | | |
|---|---|---|---|
| 3,610,470 | 10/1971 | Waters | 222/5 |
| 4,223,805 | 9/1980 | Mackal | 222/5 |
| 4,267,944 | 5/1981 | Mackal | 222/5 |
| 4,946,067 | 8/1990 | Kelsall | 441/94 |

*Primary Examiner*—Henry J. Recla
*Assistant Examiner*—Steven O. Douglas
*Attorney, Agent, or Firm*—Joseph C. Mason, Jr.; Ronald E. Smith

[57] ABSTRACT

An auto inflator having a dissolvable element that abuts and prevents sliding movement of a retainer pin that is under very low pressure. The auto inflator further includes a rotatably mounted lever arm that effects puncturing of a gas-filled cartridge by a puncture pin when the lever arm is rotated. Rotation of the lever arm occurs when the retainer pin is retracted upon dissolution of the dissolvable element. A slide member is slidably mounted in an elongate track and is biased to slide away from the retainer pin but the retainer pin, when extended, prevents that movement. The retainer pin is biased to retract, but the dissolvable element prevents that retraction until it is dissolved. Upon dissolution, the retainer pin retracts and the slide member moves along the track, pulling a lanyard with it. The lanyard is engaged to the lever arm and effects its rotation so that the puncture pin is driven into the membrane that seals the cartridge. An inspection opening in the housing is positioned so that the lever arm is visible through the opening if the head of the lever arm is bearing against the head of the puncture pin and is not visible if the lever arm is in its position of repose. Visibility of the lever arm through the opening indicates that lever arm rotation has occurred and that the cartridge is spent. Imperforate baffle walls protect the dissolvable element from small quantities of water.

14 Claims, 3 Drawing Sheets

AUTO INFLATOR HAVING DISSOLVABLE ELEMENT UNDER LOW PRESSURE

BACKGROUND OF THE INVENTION

1. Field of the Invention

This invention relates, generally, to auto inflators. More particularly, it relates to an auto inflator design that reduces the pressure on the dissolvable element.

2. Description of the Prior Art

The $CO_2$ in a $CO_2$ cartridge of the type used to rapidly inflate inflatable articles is typically under about eight hundred pounds of pressure, and about sixty to eighty pounds of pressure are required to puncture the membrane that seals the cartridge. In the known auto inflator designs, a dissolvable element is positioned between a spring-loaded pin and the membrane; when the element becomes wet, it dissolves and the pin penetrates the membrane. The pin, therefore, is directly driven into the membrane. In some designs, the pin is released into the membrane. In none of the earlier designs is the lanyard pulled automatically.

There are several drawbacks to the above-described auto inflators. First of all, a substantial bias means is required to provide the requisite sixty to eighty pounds of pressure, and the dissolvable element must be strong as well to withstand that pressure for long periods of time.

Moreover, the known auto inflators are overly sensitive to the presence of moisture, and often inflate when they should not. More particularly, they often inflate if they are simply splashed or rained upon; they have even been known to inflate under conditions of high humidity. An unwanted and unnecessary inflation wastes the cartridge and requires labor to retrieve and install another one.

Another problem in the industry is the problem of discharged cartridges that are connected to the inflator manifold of the object to be inflated. Since a cartridge may be used only once, an individual wearing a life vest that relies for its inflation upon a discharged cartridge is obviously in jeopardy. All of the known auto inflators, however, have no means for quickly determining whether or not a cartridge attached to an auto inflator has been used or not. The only known method to check the status of the cartridge is to unscrew it from the inflator and visually inspect the membrane for a puncture.

The prior art, when considered as a whole by those of ordinary skill therein, includes no teachings or suggestions as to how an auto inflator could be re-designed so that its dissolvable element would not be required to withstand sixty to eighty pounds of pressure. Moreover, no teachings exist concerning how to make an inflator that automatically pulls the lanyard as distinguished from directly driving or releasing the puncture pin. Nor does the art suggest how the unwanted inflations caused by the presence of insubstantial amounts of moisture could be avoided, or how empty cartridges could be detected without requiring removal of the cartridge from the inflator.

SUMMARY OF THE INVENTION

The improved auto inflator of this invention includes a dissolvable element that is under very low pressure, and which is protected from unwanted dissolution by the structure of the inflator. Moreover, it provides an indicator means that indicates whether or not the cartridge in the inflator has been used or not without requiring removal of said cartridge. Thus, it represents a pioneering, breakthrough development in the art.

The novel inflator has a housing made of two mating casing halves. A first casing includes most of the structural features of the invention, and the second casing is primarily a cover means. An elongate bias means has its trailing end secured to a fixed position post and its leading end secured to a slidably mounted pin engaging member. The bias means wraps around an interior wall positioned near the trailing end of the inflator housing. When the dissolvable element is dry, it bears against a pin that is biased by a very low amount of pressure such as one pound or so; the direction of the bias is inwardly, toward the dissolvable element. Thus, when the dissolvable element is immersed, it dissolves and the low bias displaces the pin toward the interior of the casing. Such inward travel of the pin causes said pin to retract from the slidably mounted pin-engaging member, and the bias of the elongate bias means pulls the pin-engaging member toward the trailing end of the inflator. A lanyard attached to said pin-engaging member is therefore displaced toward the trailing end of the inflator as well. The leading end of the lanyard is attached to a pivotally mounted lever arm that displaces a pin that punctures the cartridge membrane when the lever arm is rotated about its pivot point. Accordingly, dissolution of the element releases the pin-engaging element so that it and the lanyard are pulled back under the force provided by the elongate bias means; this effects pivotal movement of the lever arm and puncturing of the membrane.

Water can enter the housing of the auto inflator only through a plurality of slots formed in the base of the housing, and a first baffle wall is positioned between said slots and the dissolvable element so that rain or splashing water cannot come into contact with said element. A second baffle wall is positioned between the lanyard-receiving opening in the inflator and the dissolvable element for the same reason. Moreover, the element is not sensitive to moisture in the concentration found in humid air.

The lever arm is biased so that it rotates into a position of repose when there is no cartridge in the inflator or when there is a punctured cartridge therein. The bias is low so that when an unpunctured cartridge is screw threadedly received within the inflator casing, the head of the puncture pin engages the lever arm and causes it to rotate from its position of repose into its operative position. When fully rotated into its operative position, the lever arm is not visible through an inspection aperture formed in the casing. When the lever arm is in its position of repose, it will be visible through the inspection opening. Since the only object that can cause full rotation of the lever arm into its operative position is an unpunctured cartridge, this highly novel arrangement of parts provides an inflator housing having means for indicating whether or not a cartridge screw threadedly engaged therein is full or empty without removing said cartridge.

When the lever arm is fully rotated by an unpunctured cartridge, a clip carried by the lanyard will abuttingly engage the trailing end of the slide member. Thus, when the dissolvable element is dissolved, the slide member is pulled toward the post that holds the trailing end of the elongate bias means, and the lanyard is simultaneously pulled toward the same location. This displacement of the lanyard effects rotation of the lever arm and puncturing of the membrane.

Significantly, even if the dissolvable element is not dissolved, a pull on the lanyard of only about five pounds is required to cause pivotal movement of the lever arm and hence puncturing of the membrane; this provides a manual override so that an article can be inflated in the absence of the presence of moisture in the inflator.

The primary object of this invention is to provide the first inflator to automatically pull the lanyard as distinguished from directly driving or releasing the puncture pin.

Another important object is to provide the first auto inflator where the dissolvable element is under only nominal pressure.

A very closely related object is to achieve the foregoing object with a mechanically simple and reliable structure.

Another important object is to enable inspection of an auto inflator to determine if the cartridge engaged thereto is full or empty without removing the cartridge from such engagement.

Still another major object is to provide an auto inflator that is not overly sensitive to the presence of small quantities of water near the dissolvable element.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
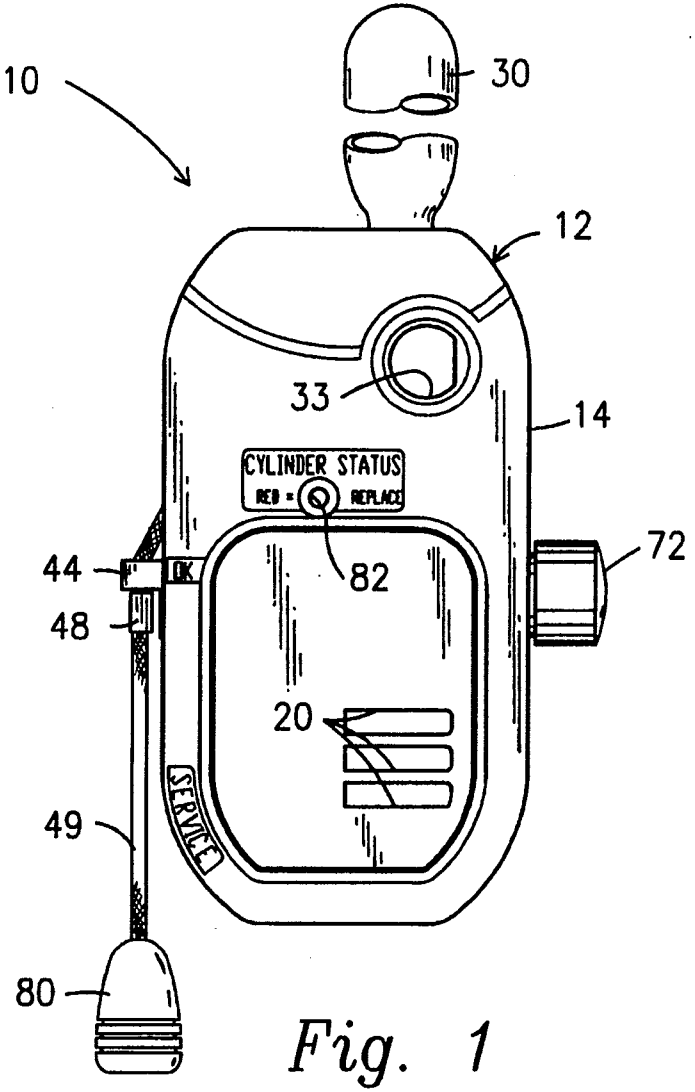
FIG. 1 is a front elevational view of an exemplary embodiment of the present invention.

Referring now to FIG. 1, it will there be seen that an illustrative embodiment of the invention is denoted as a whole by the reference numeral 10.

Figure 2:
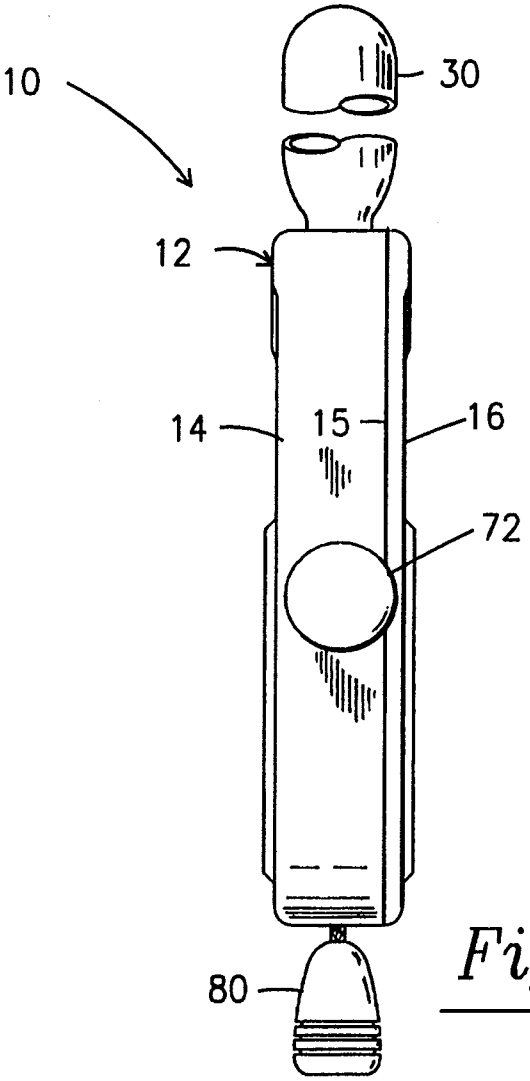
FIG. 2 is a side elevational view thereof.

As perhaps best understood in connection with FIG. 2, auto inflator 10 includes a hollow housing 12 formed of first casing part 14 and second casing part 16 that mates therewith; the parting line between said casing halves is denoted 15. A plurality of pegs, not shown, integral with casing part 16, are slidably received within cooperatively positioned sleeves, collectively denoted 18 (FIGS. 5 and 6), formed in part 14, and a suitable adhesive is employed to maintain the pegs within their associated sleeves. Other means within the scope of this invention may also be employed to maintain the casing halves 14, 16 in mating relation to one another.

Slots 20 are formed in each casing part 14, 16 to admit water into the hollow interior of the housing.

Figure 5:
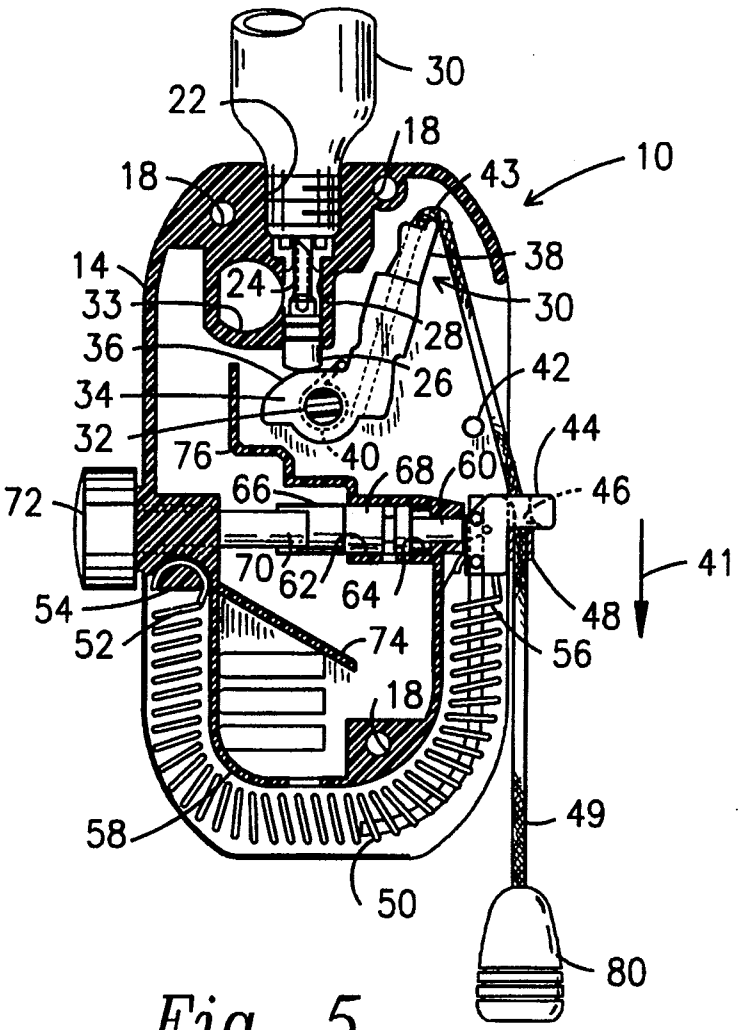
FIG. 5 is a view similar to FIG. 3, but with the rear casing removed to show the interior of the inflator when in its cocked or ready position.

Internally threaded bore 22 (FIGS. 5 and 6) is formed in a solid part of casing 14 and is in open communication with unthreaded bore 28 of smaller diameter that slidably receives a puncture pin having shank 24 and head 26; head 26 is frictionally engaged within said unthreaded bore, i.e., the pin is not biased. When a gas-filled cartridge 30 having an unpunctured membrane is screw threadedly engaged with threaded bore 22, the membrane drives head 26 of the puncture pin out of bore 28; said extended position is depicted in FIG. 5. If no cartridge is in screw threaded engagement with said bore 22, or if a cartridge having a punctured membrane is positioned therewithin, the head of the puncture pin is driven into bore 28 by torsion spring 40 which causes the lever arm 30 of the inflator to rotate into the position depicted in FIG. 6.

Lever arm 30 is mounted for rotation on a peg 32 and includes a head 34 having cam surface 36 and an elongate leg 38 that is disposed substantially normal to said head. Thus, lever arm 30 has a generally L-shaped configuration; this provides a mechanical advantage when the lever arm is rotated about its rotational axis, i.e., peg 32.

Figure 6:
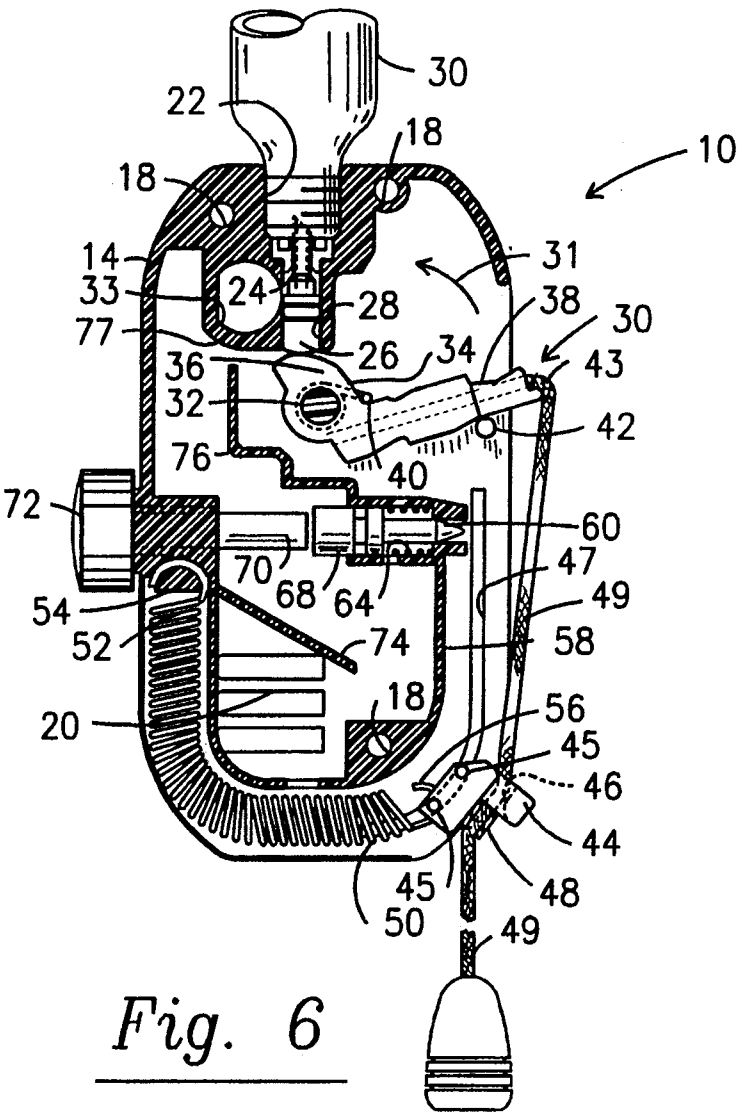
FIG. 6 is a view similar to FIG. 5, but showing the configuration of parts after the dissolvable element has dissolved.

Torsion spring 40 or other suitable bias means urges lever arm 30 into a position of repose; such position is depicted in FIG. 6. Stop pegs 42 limit the degree of rotation.

Thus, when a cartridge with an unpunctured membrane is introduced into bore 22, the shank 24 of the puncture pin will retract from bore 22 into bore 24 and head 26 of said pin will bear against cam surface 36. Note the offset relation between the longitudinal axis of the puncture pin and the axis of rotation (the center of peg 32) of lever arm 30. As the head 26 of the puncture pin extends out of bore 28, it slides relative to the cammed surface 36 of head 34 of lever arm 30 and thereby causes said lever arm to rotate from its position of repose into its cocked or ready position, i.e., in the direction indicated by directional arrow 31 in FIG. 6. When cartridge 30 is fully received within bore 22, shank 24 of the puncture pin is fully retracted relative to said bore 22 and lever arm 30 assumes its cocked or ready position as depicted in FIG. 5. Thus, rotation of said lever arm in the opposite direction will reverse the above-described movement of parts, and the shank 24 of the puncture pin will be driven through the membrane of cartridge 30, thereby releasing carbon dioxide into "D" shaped bore 33 and hence into the manifold, not shown, that is keyed thereto. The manifold is in fluid communication with the interior of an inflatable article, not shown.

The leading end 43 of lanyard 49 is received within the leg 38 of lever arm 30 as indicated in phantom lines in FIGS. 5 and 6 and is held therein by suitable means. Accordingly, displacement of said lanyard in a direction coincident with its longitudinal extent will effect rotation of said lever arm; that direction is indicated in FIG. 5 by directional arrow 41.

The means for effecting said displacement of lanyard 42 includes slide member 44 that is bored as at 46 to slidably receive the lanyard therethrough. A clip 48 secured to the lanyard has a breadth larger than the breadth of bore 46 so that it cannot extend therethrough; note that the clip is positioned on the trailing side of said slide member 44. Accordingly, movement of slide member 44 in the direction indicated by directional arrow 41 will cause lanyard 42 to displace in said direction and the membrane of any cartridge positioned in bore 22 will be punctured because such travel of said slide member will effect rotation of lever 30 from its FIG. 5 position to its FIG. 6 position.

Figure 4:
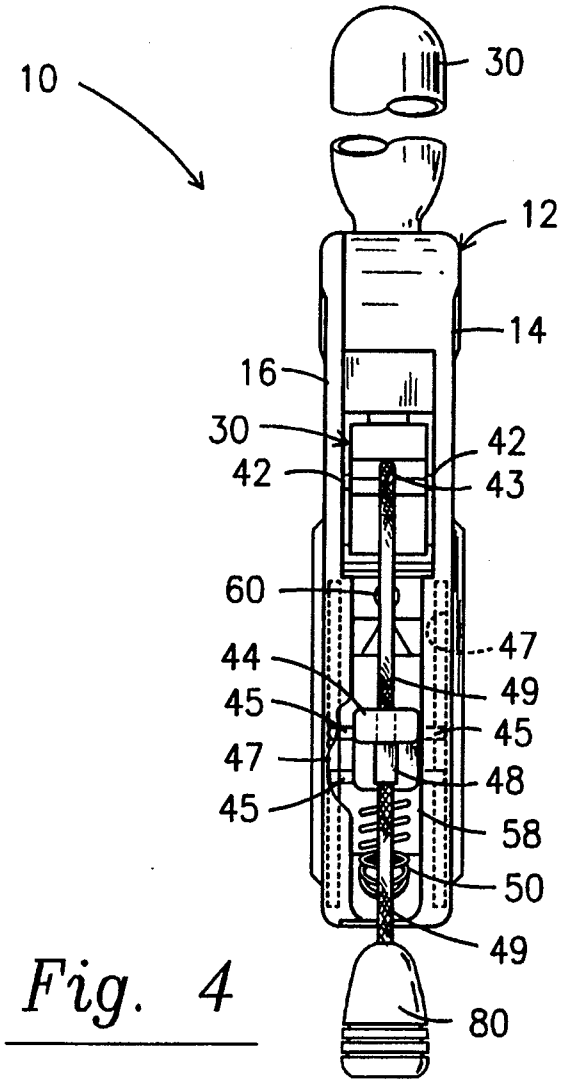
FIG. 4 is a side elevational view thereof.

Slide member 44 includes pegs 45 that project from opposite sides thereof into tracks 47, as perhaps best shown in FIG. 4. Thus, pegs 45 of slide member 44 are free to travel along the extent of their associated tracks 47; this assures non-binding travel of said slide member along said tracks. Numerous other means for enabling smooth and unrestricted travel of said slide member are within the scope of this invention.

Movement of slide member 44 from its FIG. 5 position to its FIG. 6 position is urged by elongate bias means 50. It has a trailing end 52 secured to a post 54 and a leading end 56 secured to slide member 44. Bias means 50 extends along a generally u-shaped path of travel that is defined by generally u-shaped interior wall 58 that, like post 54, is formed integrally with casing part 14 and which projects upwardly therefrom- Many suitable alternatives to bias means 50 exist and all of said alternatives are within the scope of this invention- For example, a spiral spring of the type used in clocks could be used in lieu of elongate bias means 50.

A slide member retaining pin having a shank 60 is slidably mounted in a bore 62 formed in another solid part of casing half 14. It is biased toward the hollow interior of the housing by retaining pin bias means 64; importantly, the amount of inward bias is only one pound in a preferred embodiment of the invention; other amounts of bias are within the scope of this invention. When in its retracted position, shank 60 of said slide member retaining pin does not engage slide member 44 and elongate bias means 50 thus pulls said slide member into its position of repose, as depicted in FIG. 6. When in its extended position, as depicted in FIG. 5, shank 60 is received within a bore formed in slide member 44 and holds said slide member in its FIG. 5 position.

Shank 60 of said retaining pin is held into its extended position by dissolvable element 66; element 66 is shown in FIG. 5 but not in FIG. 6 because FIG. 6 represents the post-dissolution configuration of inflator 10. More particularly, element 66, which is preferably of solid cylindrical construction, bears against head 68 of the retaining pin and overcomes the bias of retainer pin bias means 64 to maintain the engagement of shank 60 within the shank-receiving bore formed in the slide member 44. When said dissolvable element is destroyed by moisture, the bias of bias means 64 retracts retaining pin 60 into the hollow interior of the housing 12 as aforesaid and as depicted in FIG. 6 and thus frees slide member 44. Note that dissolvable element 66 is frictionally engaged onto the free end of a post 70 having internally threaded cap 72 that screw threadedly engages an externally threaded, tubular boss formed in casing half 14. This structure enables facile replacement of dissolvable element 66.

Baffle wall 74 protects dissolvable element 66 from raindrops or water that might splash through slots 20, and baffle wall 76 protects said element from water that might enter into the hollow interior of housing 12 through the lanyard-receiving opening. Note that the distal end of baffle wall 76 is slightly spaced apart from solid part 77 of casing 14 to provide a venting means that enables water to enter said hollow interior in the event housing 12 is immersed.

Handle 80 may also be pulled to effect puncturing of the membrane in the absence of moisture; about five pounds of pressure will overcome the engagement of the retaining pin 60 with slide member 44; the rest of the power to rotate lever arm 30 is provided by elongate bias means 50.

Figure 3:
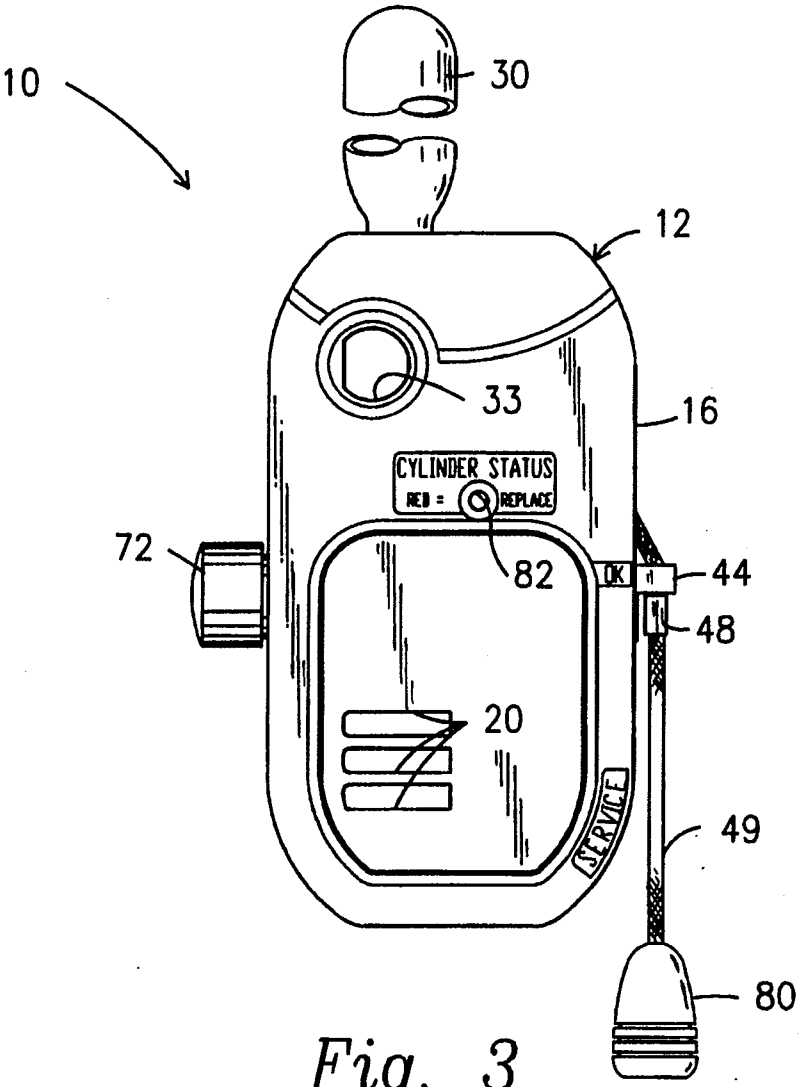
FIG. 3 is a rear elevational view thereof.

To cock unit 10, i.e., to prepare it for use, the bias of elongate bias means 50 is overcome manually; slide member 44 is simply pulled into its FIG. 5 position until retainer pin 60 enters thereinto under the influence of bias means 64. If no cartridge 30 is screwed into bore 22, lever arm 30 will remain in its position of repose (its FIG. 6 position as aforesaid); it also remains in said position of repose if a cartridge having a punctured membrane is screw threadedly engaged into bore 22. In both situations, torsion spring 40 will bias lever arm 30 into said position of repose, and the lever arm, which is preferably red in color, will be visible through inspection opening 82 formed in each of the casing halves 14 and 16 (see FIGS. 1 and 3). The only way to rotate the lever arm 30 out of said position of repose and into the cocked position of FIG. 5 is by inserting a cartridge having an unpunctured membrane into bore 22. The membrane bears against the pointed end of shank 24 of the puncture pin, driving it out of bore 22 and causing head 26 of said puncture pin to engage camming surface 36 of head part 34 of lever arm 30 as mentioned earlier to rotate said lever arm 30 about pivot pin 32, thereby overcoming the bias of torsion spring 40. Note that such rotation of lever arm 30 from its FIG. 6 position of repose to its FIG. 5 cocked position can take place only when slide member 44 is in its FIG. 5 position. Thus, it should be understood that lever arm 30 may be in its FIG. 6 position of repose when slide member 44 is in its FIG. 5 cocked position. Said lever arm would assume such position of repose when there is no cartridge installed or when a punctured cartridge is installed. The only way to place lever arm 30 in its FIG. 5 position is to place slide member 44 in its FIG. 5 position and to install an unpunctured cartridge 30. Such installation rotates the lever arm 30 from its FIG. 6 to its FIG. 5 position, and said lever arm, which is preferably red in color, will not be visible through inspection openings 82 on the front and back of inflator 10 when so rotated, thereby indicating that a cartridge 30 is present in the inflator, and that the membrane of said cartridge has not been punctured. This arrangement of parts provides an inflator that enables a user or inspector to determine the punctured or unpunctured status of a cartridge in an inflator without removing said cartridge from said inflator.

Significantly, the novel inflator is the first inflator to automatically pull the lanyard; no direct driving or releasing of the puncture pin is involved.

This invention is clearly new and useful. Moreover, it was not obvious to those of ordinary skill in this art at the time it was made, in view of the prior art considered as a whole as required by law.

This invention pioneers the art of inflators having dissolvable elements under low pressure, and having means for automatically pulling the lanyard in the absence of directly driving or releasing the puncture pin. Accordingly, the claims that follow are entitled to broad interpretation, as a matter of law, to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An inflator, comprising:

a hollow housing;

a lever arm pivotally mounted in said hollow housing;

said lever arm having a cocked position and a position of repose;

a bias means for urging said lever arm into said position of repose;

said lever arm including a head and said head having a cammed surface;

a puncture pin being slidably mounted in said hollow housing;

said puncture pin having a head and a shank, said puncture pin head disposed in abutting relation to said cammed surface of said lever arm head when said lever arm is in its cocked position and when said lever arm is in its position of repose, said shank being adapted to puncture a membrane of a cartridge introduced into said hollow housing when said lever arm is in its position of repose;

said puncture pin being retracted into said hollow housing when a cartridge having an unpunctured membrane is introduced into said hollow housing;

said puncture pin head bearing against said cammed surface of said lever arm head when a cartridge having an unpunctured membrane is introduced into said hollow housing;

said lever arm being rotated into said cocked position when said puncture pin head bears against said cammed surface of said head of said lever arm;

said lever arm remaining in said position of repose when no cartridge is connected to said hollow housing and when a cartridge having a punctured membrane is installed in said hollow housing;

an inspection opening formed in said hollow housing, said inspection opening having a preselected position so that said lever arm is visible through said inspection opening when said lever arm is in its position of repose and so that said lever arm is not visible through said inspection opening when said lever arm is in said cocked position;

whereby the presence of a cartridge having a punctured membrane and the absence of a cartridge are both indicated by the visibility of said lever arm through said inspection opening and the presence of a cartridge having an unpunctured membrane is indicated by an absence of visibility of said lever arm through sad inspection opening.

2. The inflator of claim 1, further comprising a lanyard secured to a free end of said lever arm, said lanyard effecting rotation of said lever arm from said cocked position to said position of repose when said lanyard is pulled.

3. The inflator of claim 2, further comprising:

an interior wall formed in said housing for defining a track means;

said track means having a leading end and a trailing end;

an elongate bias means disposed within said track means;

means for fixedly securing a trailing end of said elongate bias means to said trailing end of said track means;

a slide member adapted for slidable movement within said track means;

means for interconnecting said slide member and said lanyard;

said slide member being secured to a leading end of said elongate bias means;

a retaining pin, slidably mounted in said hollow housing, having a retracted position and an extended position, said retaining pin maintaining said slide member at said leading end of said track means when said retaining pin is in said extended position;

means for biasing said retaining pin into said retracted position; and a dissolvable element positioned in abutting engagement to said retaining pin and holding said retaining pin in said extended position;

whereby dissolution of said dissolvable element enables retraction of said retaining pin, slidable movement of said slide member from said leading end of said track means toward said trailing end thereof under the bias of said elongate bias means, and rotation of said lever arm about its axis of rotation so that said puncture pin means is driven into said extended position, thereby effecting puncturing of a cartridge membrane.

4. The auto inflator of claim 3, further comprising:

at least one water-admitting opening formed in said housing; and at least one imperforate baffle wall positioned within said housing between said at least one water-admitting opening and said dissolvable element so that small quantities of water splashing into said water-admitting opening do not impinge against said dissolvable element.

5. The auto inflator of claim 3, wherein said elongate bias means is extended along a generally u-shaped path of travel when said slide member is retained at said leading end of said track means by said retaining pin.

6. The auto inflator of claim 3, wherein the amount of bias on said retaining pin and hence the amount of pressure on said dissolvable element is about one pound.

7. The auto inflator of claim 3, further comprising a clip carried by said lanyard, an aperture formed in said slide member for slidably receiving said lanyard, and said clip having a breadth greater than the breadth of said aperture so that it cannot pass therethrough, whereby travel of said slide member from the leading end of said track means toward said trailing end thereof effects pulling of said lanyard and hence rotation of said lever arm about its rotational axis.

8. An inflator, comprising:

a hollow housing;

a puncture pin means slidably mounted within said housing, said puncture pin means having a retracted position and an extended position, said puncture pin means being adapted to puncture a cartridge membrane when in said extended position;

a lever arm mounted for rotation in said housing;

said lever arm having a cocked position where it abuttingly engages said puncture pin means when said puncture pin means is in said retracted position;

a lanyard secured to a free end of said lever arm, said lanyard effecting rotation of said lever arm when said lanyard is pulled;

an interior wall formed in said housing for defining a track means;

said track means having a leading end and a trailing end;

an elongate bias means disposed within said track means;

post means for fixedly securing a trailing end of said elongate bias means to said trailing end of said track means;

a slide member adapted for slidable movement within said track means;

means for interconnecting said slide member and said lanyard;

said slide member being secured to a leading end of said elongate bias means;

a slidably mounted retaining pin having a retracted position and an extended position, said retaining pin maintaining said slide member at said leading end of said track means when in its extended position;

means for biasing said retaining pin into its retracted position; and a dissolvable element positioned in abutting engagement to said retaining pin and holding said retaining pin in its extended position;

whereby dissolution of said dissolvable element enables retraction of said retaining pin, slidable movement of said slide member from said leading end of said track means toward said trailing end thereof under the bias of said elongate bias means, and rotation of said lever arm about its axis of rotation so that said puncture pin means is driven into its extended position, thereby effecting puncturing of a cartridge membrane.

9. The auto inflator of claim 8, further comprising:

a lever arm bias means for urging said lever arm to rotate away from said cocked position, into a position of repose, said bias means being ineffective to effect rotation of said lever arm into said position of repose when said puncture pin means is in its retracted position and said lever arm bias means being effective to rotate said lever arm into said position of repose when said puncture pin is not in said retracted position so that absence of a cartridge from said auto inflator or the presence of a punctured cartridge in said auto inflator results in rotation of said lever arm into said position of repose.

10. The auto inflator of claim 8, further comprising an inspection opening formed in said housing at a predetermined location, said inspection opening enabling viewing of said lever arm when said lever arm is in its position of repose and said lever arm not being visible through said inspection opening when in its cocked position.

11. The auto inflator of claim 8, further comprising:

at least one water-admitting opening formed in said housing; and at least one imperforate baffle wall positioned within said housing between said at least one water-admitting opening and said dissolvable element so that small quantities of water splashing into said water-admitting opening do not impinge against said dissolvable element.

12. The auto inflator of claim 8, wherein said elongate bias means is extended along a generally u-shaped path of travel when said slide member is retained at said leading end of said track means by said retaining pin.

13. The auto inflator of claim 8, wherein the amount of bias on said retaining pin and hence the amount of pressure on said dissolvable element is about one pound.

14. The auto inflator of claim 8, further comprising a clip carried by said lanyard, an aperture formed in said slide member for slidably receiving said lanyard, and said clip having a breadth greater than the breadth of said aperture so that it cannot pass therethrough, whereby travel of said slide member from the leading end of said track means toward said trailing end thereof effects pulling of said lanyard and hence rotation of said lever arm about its rotational axis.

* * * * *